United States Patent [19]

Kohnken

[11] Patent Number: 4,688,629

[45] Date of Patent: Aug. 25, 1987

[54] HEAT RECUPERATOR HAVING CERAMIC CORE

[75] Inventor: Kent H. Kohnken, Towanda, Pa.

[73] Assignee: GTE Products Corporation, Stamford, Conn.

[21] Appl. No.: 324,320

[22] Filed: Nov. 23, 1981

[51] Int. Cl.[4] ..... F28F 3/08

[52] U.S. Cl. ..... 165/82; 165/166; 165/905

[58] Field of Search ..... 165/81, 82, 166, DIG. 8; 277/22, 26; 285/212, 76

[56] References Cited

U.S. PATENT DOCUMENTS 2,550,560 4/1951 Heron ..... 165/DIG. 8
4,083,400 4/1978 Dziedzic ..... 165/82 X

FOREIGN PATENT DOCUMENTS 1067923 11/1979 Canada ..... 277/22

*Primary Examiner*—William R. Cline
*Attorney, Agent, or Firm*—James Theodosopoulos

[57] ABSTRACT

In a recuperator having a ceramic core within a housing, a layer of intumescent material is disposed between a solid face of the core and the housing to aid in securing the core within the housing.

3 Claims, 2 Drawing Figures

HEAT RECUPERATOR HAVING CERAMIC CORE

This invention concerns ceramic cross-flow heat recuperators. Such recuperators comprise a ceramic heat-exchanger core within a suitable housing and are shown in U.S. Pat. Nos. 3,948,317, 4,083,400, 4,130,160, 4,262,740, 4,279,297 and 4,300,627.

In such recuperators, it is desirable to maintain the ceramic core securely held or maintained under compression within the housing. Otherwise, during use, the core may twist within the housing and split or crack.

In accordance with this invention, a layer of a suitable intumescent material is placed between the ceramic core and the housing. Upon heating of the recuperator, the intumescent material expands and secures the core within the housing.

Figure 1:
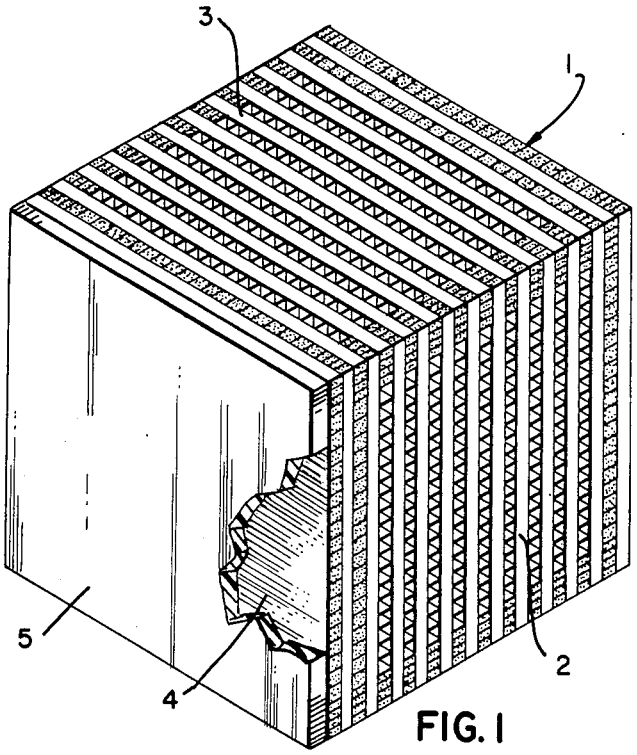
FIG. 1 shows a ceramic core in accordance with this invention.

In a ceramic core 1 in accordance with this invention, two opposing faces 2 (only one shown in FIG. 1) serve as the inlet and outlet for a gas to be heated, for example, combustion air, and two opposing faces 3 (only one shown in FIG. 1) serve as the inlet and outlet for hot exhaust gases, as disclosed in U.S. Pat. No. 4,300,627. The two remaining faces 4 (only one shown in FIG. 1) are both solid and a layer 5 of intumescent material is disposed on one or both of said solid faces. The intumescent material should contain a sufficient quantity of ceramic or similar refractory matter in order to withstand the elevated temperatures encountered during recuperator operation without significantly losing body or strength.

Figure 2:
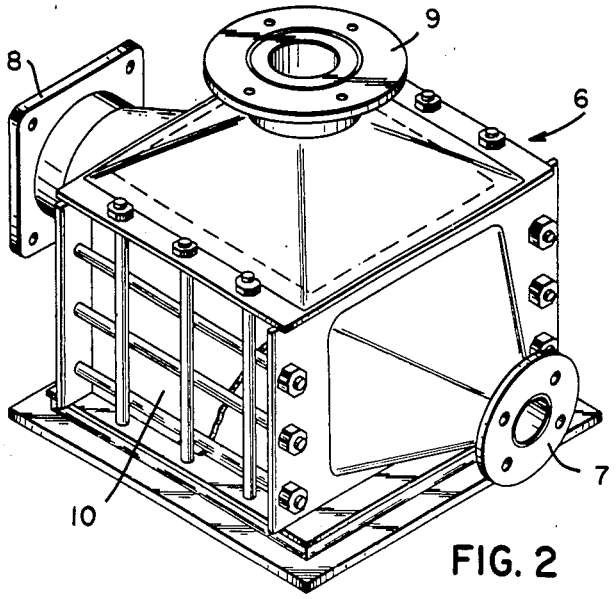
FIG. 2 shows the recuperator.

A housing 6 for core 1, as shown in FIG. 2, comprises an inlet 7 and an outlet 8 for the combustion air. The hot exhaust gasses enter at the bottom of housing 6 (not shown) and exit through outlet 9. Layer 5 (not shown in FIG. 2) is disposed between plate 10 of housing 6 and solid face 5 of core 1 (not shown in FIG. 2). Layer 5 may also be disposed between the other solid face and its respective plate of housing 6.

In one embodiment, layer 5 may comprise a $\frac{1}{4}''$ thick layer of Fire Barrier Sheet FS-195 made by the Technical Ceramics Product Division of 3M Corporation, St. Paul, Minn. The sheet begins to expand at 250° F. and has significant expansion at 350° F. If desired, the recuperator may be heated after assembly in order to intumesce layer 5. Or intumescence may await first operation of recuperator, where the temperatures encountered should be sufficient to initiate intumescence.

Layer 5 may also be disposed between the solid face of a ceramic core and the refractory lining of a housing, such as shown in U.S. Pat. No. 4,262,740.

I claim:

1. In a recuperator comprising a ceramic heat-exchanger core within a housing, the core having six faces, two solid and four having openings for the flow of gas therethrough, the improvement comprising a layer of intumescent material disposed between a solid face and the housing.

2. The recuperator of claim 1 wherein there is a layer of intumescent material between each solid face and the housing.

3. The recuperator of claim 1 wherein the layer of intumescent material maintains the core under compression within the housing.

* * * * *